US010145175B2

(12) United States Patent
Rooney et al.

(10) Patent No.: US 10,145,175 B2
(45) Date of Patent: Dec. 4, 2018

(54) STAIR

(71) Applicant: SEW-N-SEW PTY LTD, Coburg, Victoria (AU)

(72) Inventors: Peter Rooney, Coburg (AU); Karen Rooney, Coburg (AU)

(73) Assignee: SEW-N-SEW PTY LTD, Victoria (AU)

( * ) Notice: Subject to any disclaimer, the term of this patent is extended or adjusted under 35 U.S.C. 154(b) by 9 days.

(21) Appl. No.: 15/128,809

(22) PCT Filed: Feb. 13, 2015

(86) PCT No.: PCT/AU2015/000082
§ 371 (c)(1),
(2) Date: Sep. 23, 2016

(87) PCT Pub. No.: WO2015/143474
PCT Pub. Date: Oct. 1, 2015

(65) Prior Publication Data

US 2017/0107761 A1 Apr. 20, 2017

(30) Foreign Application Priority Data

Mar. 25, 2014 (AU) ..... 2014901058

(51) Int. Cl.
*E06C 1/00* (2006.01)
*A47B 97/00* (2006.01)
(Continued)

(52) U.S. Cl.
CPC ..... *E06C 1/005* (2013.01); *A47B 77/10* (2013.01); *A47B 97/00* (2013.01); *A47B 91/005* (2013.01); *A47B 2220/05* (2013.01)

(58) Field of Classification Search
CPC ..... E06C 1/005; A47B 77/10; A47B 97/00; A47B 91/005; A47B 2220/05;
(Continued)

(56) References Cited

U.S. PATENT DOCUMENTS 4,657,113 A * 4/1987 Costello ..... E04G 1/22 182/152
5,005,667 A * 4/1991 Anderson ..... A47B 77/10 182/15

(Continued)

FOREIGN PATENT DOCUMENTS

CN 102370350 A 3/2012
DE 102007045215 A1 4/2009

(Continued)

OTHER PUBLICATIONS

Written Opinion of the International Searching Authority dated Mar. 2, 2015, for corresponding International Application No. PCT/AU2015/000082, filed Feb. 13, 2015.

(Continued)

*Primary Examiner* — Katherine W Mitchell
*Assistant Examiner* — Shiref M Mekhaeil
(74) *Attorney, Agent, or Firm* — David D. Brush; Westman, Champlin & Koehler, P.A.

(57) ABSTRACT

A stair including at least one tread portion and an elevating mechanism by which the tread portion is elevatable to a deployed position in which the tread portion is presented to be stepped on by a person. The stair further includes a pedal. The elevating mechanism includes a stop and a striking portion. The striking portion is arranged to move into abutment with the stop when the tread portion is so elevated to its deployed position. The striking portion is also arranged to be driven against the stop by at least a portion of the person's weight. The pedal is pressible to move the striking portion away from the stop. The elevating mechanism is configured such that, when the striking portion is so moved away, depressing the tread portion moves the striking portion further away from the stop.

7 Claims, 7 Drawing Sheets

(51) Int. Cl.
*A47B 77/10* (2006.01)
*A47B 91/00* (2006.01)

(58) Field of Classification Search
CPC ..... A47B 46/00; A47C 12/00; A47C 12/02; A47C 13/00; A47C 13/005
USPC ..... 182/36
See application file for complete search history.

(56) References Cited

U.S. PATENT DOCUMENTS 5,009,282 A 4/1991 Willsher
5,660,405 A 8/1997 Campbell
6,880,835 B2 * 4/2005 Tornabene ..... B62B 1/002 182/20
8,511,693 B2 * 8/2013 Gass ..... B25H 1/04 280/43.14
8,888,110 B2 * 11/2014 Sadeh ..... B62B 5/049 280/30
2002/0189017 A1 12/2002 Siepmann et al.
2008/0264723 A1 * 10/2008 Tatum ..... A47C 12/00 182/35
2009/0188754 A1 * 7/2009 Warren ..... E06C 1/397 182/141
2010/0187782 A1 * 7/2010 Facey ..... B60T 1/14 280/30
2013/0213738 A1 8/2013 Schroeder

FOREIGN PATENT DOCUMENTS

EP 1611832 B1 9/2006
EP 1366692 B1 3/2010
JP H09299176 A 11/1997

OTHER PUBLICATIONS

International Search Report dated Mar. 2, 2015, for corresponding International Application No. PCT/AU2015/000082, filed Feb. 13, 2015.
Australian Search Report and Written Opinion dated Jan. 16, 2015 for corresponding Australian Application No. 2014901058, filed Mar. 25, 2014.
English translation of the Office Action dated Jun. 27, 2018 from the State Intellectual Property Office of China for corresponding Chinese Application No. 2015800162935.

* cited by examiner

STAIR

CROSS-REFERENCE TO RELATED APPLICATION

This Application is a Section 371 National Stage Application of International Application No. PCT/ AU2015/000082, filed Feb. 13, 2015 and published as WO 2015/143474 A1 on Oct. 1, 2015, in English, the contents of which are hereby incorporated by reference in their entirety.

FIELD

The invention relates to a stair.

The invention will be described with reference to stairs for use in a kitchen although variants of the invention may well be usefully applied elsewhere.

BACKGROUND

Reaching items placed on high shelves or in high cupboards can be difficult, particularly for those shorter in stature. To aid in reaching such items, various stair arrangements have been employed.

A conventional tradesman's ladder includes multiple tread portions referred to as rungs. Six foot is a common height for a tradesman's ladder. A ladder of this size is inconvenient in the context of a kitchen.

A step-stool is another form of stair often employed in kitchens. Typical step-stools include a padded seat portion and a stair module carried thereunder. The stair module typically includes two treads and the module is mounted under the seat to pivot from a stowed position directly underlying the seat outwardly to a deployed position in which the treads are presented to be stepped on.

Step-stools can also be too bulky for a kitchen. Ladders and step-stools also have the potential to topple should a person lean too far beyond the footprint of the ladder or stool. Of course, such toppling is dangerous.

Another form of an existing stair is referred to as a kick-step, which typically takes the form of a unitary body of plastic which presents a single tread on which a user may stand and which may be conveniently kicked about the kitchen to any desired position.

Kick-steps are typically less bulky and, being lower, less prone to toppling than ladders and step-stools. On the other hand, given their smaller size, kick-steps can be overlooked and so pose a tripping hazard.

Often a ladder, step-stool or kick-step is not available, e.g. because they have been packed away because they are unsightly. The absence of stairs often leads people to improvise by standing upon chairs and the like. This improvisation is particularly dangerous.

U.S. Pat. No. 5,005,667 discloses a stair in the form of an extensible and retractable step assembly. The step assembly includes slidable pivot linkages connecting the step to the base and permitting the step to be raised from the base when the base is extended in front of a cabinet. FIG. 2 of the patent is produced herein as FIG. 1. The patent includes:

"[w]hen the step S is raised and pulled forward, the cross pins 51 and 51*a* on the lower ends of linkage arms 49 and 49a are seated in the downwardly-offset notches 48 and 48*a* at the front ends of the respective slots 44 and 44*a*. This is a stable position of the linkages in which a weight on the step S, such as that of a person stepping on it, tends to maintain the linkage arms in this position.

To lower the step S into the base B, the user lifts the step enough to raise the cross pins 51 and 51 a on the lower ends of linkage arms 49 and 49a out of the downwardly offset notches 48 and 48*a* at the front ends of slots 44 and 44*a*. Then, these cross pins can be slid back along these slots to the fully retracted position."

Whilst the author of the document thought the raised position was a stable position, the present inventor has recognised that weight applied forward of the pivotal connection 50 in the vicinity of the front wall 40 has the potential to lift the cross pin 51*a* from its notch 48*a*, which may result in the step collapsing as a person moves their weight around on the step. Reaching down to raise and lower the step is also thought to be less than desirable.

With the foregoing in mind, the present invention aims to provide improvements in and for stairs or at least to provide an alternative in the marketplace.

It is not admitted that any of the information in this patent specification is common general knowledge, or that the person skilled in the art could be reasonably expected to ascertain or understand it, regard it as relevant or combine it in any way at the priority date.

SUMMARY

One aspect of the invention provides a stair including at least one tread portion;

an elevating mechanism by which the tread portion is elevatable to a deployed position in which the tread portion is presented to be stepped on by a person; and a pedal;

the elevating mechanism including a stop; and a striking portion arranged to move into abutment with the stop when the tread portion is so elevated to its deployed position, and be driven against the stop by at least a portion of the person's weight;

the pedal being pressible to move the striking portion away from the stop;

the elevating mechanism being configured such that, when the striking portion is so moved away, depressing the tread portion moves the striking portion further away from the stop.

The stair preferably includes a guide; and a portion relatively movable along the guide; wherein the stop is at least one of a portion of or fixed relative to the guide, and the relatively movable portion; and the striking portion is the other of the portion of or fixed relative to the guide, and the relatively movable portion.

Preferably the striking portion is the relatively movable portion.

In variants where the striking portion drops a distance as it approaches the stop, the pedal is preferably pressible to lift the striking portion the distance.

The stair preferably includes a supporting portion relative to which the tread portion rises on the tread portion's way to its deployed position; and at least one member arranged to, when the tread portion is in its deployed position, define a load path for transmitting at least a portion of the person's weight from the tread portion to the supporting portion;

a first interconnection at which the at least one member is connected to the supporting portion, and a second interconnection at which the at least one member is connected to the tread portion;

wherein at least one of the interconnections includes the stop and the striking portion.

The first interconnection is preferably the at least one of the interconnections.

The striking portion may be a portion of or carried by the member.

The stair may include a portion connected to the tread portion to move as the tread portion is lowered; and one or more blocking portions;

the pedal being connected to the blocking portion(s) such that pressing the pedal moves the blocking portion(s)

from position(s) in which the blocking portion(s) block, the portion connected to the tread portion, to at least limit lowering of the tread portion, to position(s) in which the tread portion is lowerable.

Another aspect of the invention provides a stair including at least one tread portion lowerable from a deployed position in which the tread portion is presented to be stepped on by a person;

a portion connected to the tread portion to move as the tread portion is lowered;

one or more blocking portions; and a pedal connected to the blocking portion(s) such that pressing the pedal moves the blocking portion(s)

from position(s) in which the blocking portion(s) block, the portion connected to the tread portion, to at least limit lowering of the tread portion, to position(s) in which the tread portion is lowerable.

The blocking portions and the pedal may be portions of a member. The blocking portions may be arranged to at least substantially pivot, about a pivot axis, with the pedal.

Preferably the portion connected to the tread portion extends across the pivot axis; and on each side of the pivot axis is positioned a respective at least one of the blocking portions.

The pivot axis preferably runs at least approximately horizontally.

The portion connected to the tread portion may be a horizontally extending member.

The stair of either one of the foregoing aspects preferably includes a mechanism by which the tread portion is mounted to move from a stowed position in which a person may stand on a portion of a floor;

to a deployed position in which the tread portion is presented, over the portion of the floor, to be stepped on by the person;

the deployed position being higher than the stowed position;

the mechanism, by which the tread portion is mounted, including the elevating mechanism.

One or more supports may be mounted to move, as the tread portion is so moved, to a position in which the supports engage the floor to transmit to the floor at least a portion of the person's weight. Preferably the support(s) are mounted to closely follow the floor as they so move. The support(s) may be configured to engage the floor to resist sliding across the floor whilst the stair is bearing a portion of the person's weight. Preferably the support(s) are so configured by the inclusion of high friction surface(s).

The stair preferably includes a push-to-open mechanism which is foot-actuatable to move the tread portion away from its stowed position. The push-to-open mechanism is preferably configured to drive the tread portion to a partially deployed position vertically below and in alignment with the tread portion's deployed position.

Preferably the portion of the floor is adjacent a furniture item; and the stair includes a portion positionable at the base of the furniture item; and a fascia;

the positionable portion includes the tread portion and the mechanism by which the tread portion is mounted to move, and the fascia is attachable to the positionable portion, when the portion is so positioned, at more than one orientation relative to the positionable portion such that the fascia is alignable relative to the furniture item.

Another aspect of the invention provides a stair including a tread portion;

a mechanism by which the tread portion is mounted to move from a stowed position in which a person may stand on a portion of a floor adjacent a furniture item, to a deployed position in which the tread portion is presented, over the portion of the floor, to be stepped on by the person;

a portion positionable at the base of the furniture item; and a fascia;

the positionable portion including the tread portion and the mechanism by which the tread portion is mounted to move;

the fascia being attachable to the positionable portion, when the portion is so positioned, at more than one orientation relative to the positionable portion such that the fascia is alignable relative to the furniture item.

Preferably the positionable portion is attachable to the furniture item; and includes a stationary portion; and the stationary portion includes height-adjustable feet.

Another aspect of the invention provides a stair including a tread portion;

a mechanism by which the tread portion is mounted to move from a stowed position in which a person may stand on a portion of a floor adjacent a furniture item;

to a deployed position in which the tread portion is presented, over the portion of the floor, to be stepped on by the person; and a portion positionable at the base of the furniture item;

the positionable portion including the tread portion;

the mechanism by which the tread portion is mounted to move; and a stationary portion;

the stationary portion including height-adjustable feet.

Another aspect of the invention provides the stair of any one of the foregoing aspects when used in a kitchen.

Another aspect of the invention provides a method, of installing a stair, including positioning, a positionable portion, at the base of a furniture item; then aligning a fascia relative to the furniture item; and attaching the fascia to the positionable portion whilst the fascia is so aligned;

the positionable portion including a tread portion; and a mechanism by which the tread portion is mounted to move from a stowed position in which a person may stand on a portion of a floor adjacent the furniture item, to a deployed position in which the tread portion is presented, over the portion of the floor, to be stepped on by the person.

Another aspect of the invention provides a stair including at least one tread portion;

a mechanism by which the tread portion is mounted to move from a stowed position in which a person may stand on a portion of a floor to a deployed position in which the tread portion is presented, over the portion of the floor, to be stepped on by the person; and one or more supports mounted to move, as the tread portion is so moved, to a position in which the supports engage the floor to transmit to the floor at least a portion of the person's weight.

Another aspect of the invention provides a stair including at least one tread portion; and a mechanism by which the tread portion is mounted to move from a stowed position in which a person may stand on a portion of a floor to a deployed position in which the tread portion is presented, over the portion of the floor, to be stepped on by the person; and a push-to-open mechanism which is foot-actuatable to move the tread portion away from its stowed position.

Preferably the push-to-open mechanism is configured to drive the tread portion to a partially deployed position vertically below and in alignment with the tread portion's deployed position.

In preferred forms of the stair, the push-to-open mechanism includes an elongate resiliently compressible member mounted to, as the tread portion moves from its stowed position to its deployed position, pivot away from a direction transverse to a direction in which the tread portions moves from its stowed position to its partially deployed position, toward the direction in which the tread portion moves from its stowed position to its partially deployed position.

Preferably the deployed position is higher than the stowed position.

Another aspect of the invention provides a stair including at least one tread portion;

a mechanism by which the tread portion is mounted to move from a stowed position in which a person may stand on a portion of a floor to a deployed position in which the tread portion is presented, over the portion of the floor, to be stepped on by the person;

wherein the deployed position is higher than the stowed position.

The mechanism preferably includes a stop; and a striking portion arranged to move into abutment with the stop when the tread portion so moves from its stowed position to its deployed position, and be driven against the stop by at least a portion of the person's weight.

Another aspect of the invention provides a stair including at least one tread portion; and a mechanism by which the tread portion is elevatable from a stowed position, and to a deployed position in which the tread portion is presented to be stepped on by the person;

wherein the mechanism includes a stop; and a striking portion arranged to move into abutment with the stop when the tread portion is so elevated from its stowed position to its deployed position, and be driven against the stop by at least a portion of the person's weight.

The stair preferably includes a guide; and a portion relatively movable along the guide; wherein the stop is at least one of a portion of or fixed relative to the guide, and the relatively movable portion; and the striking portion is the other of the portion of or fixed relative to the guide, and the relatively movable portion.

Preferably the striking portion is the relatively movable portion.

The stair may include a supporting portion relative to which the tread portion rises on the tread portion's way to its deployed position; and at least one member arranged to, when the tread portion is in its deployed position, define a load path for transmitting at least a portion of the person's weight from the tread portion to the supporting portion;

a first interconnection at which the at least one member is connected to the supporting portion, and a second interconnection at which the at least one member is connected to the tread portion;

wherein at least one of the interconnections includes the stop and the striking portion.

Preferably the first interconnection is the at least one of the interconnections. It is also preferred that the other of the interconnections is a pivotal connection. The striking portion may be a portion of or carried by the member.

A mechanism may be provided for moving away from the stop the striking portion;

wherein the mechanism by which the tread portion is mounted to move is configured such that, when the striking portion is so moved away, depressing the tread portion moves the striking portion away from the stop.

Preferably the mechanism for moving away from the stop the striking portion includes a pedal by which it is actuatable.

The stair is preferably in substance entirely mechanical.

Another aspect of the invention provides the stair when used in a kitchen.

DESCRIPTION OF EMBODIMENTS

Figure 1:
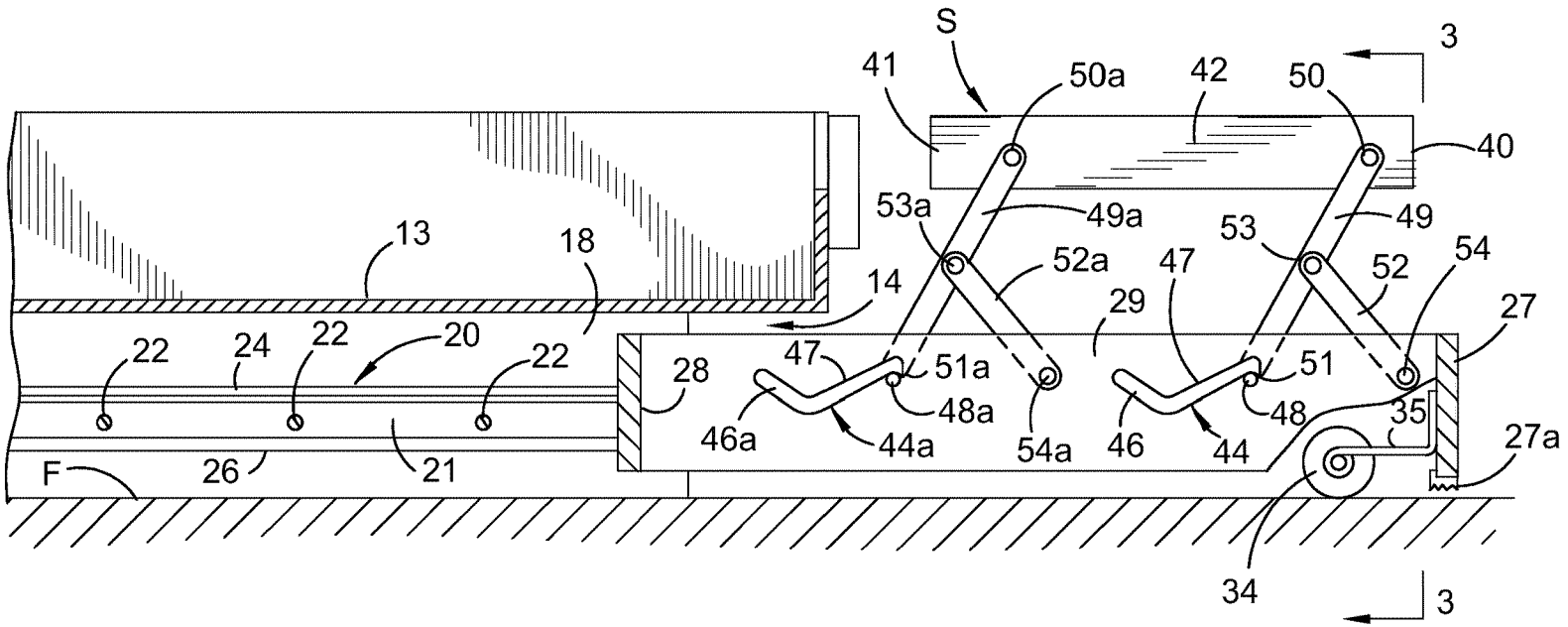
FIGURE 1 PRIOR ART
FIG. 1 is a reproduction of FIG. 2 of U.S. Pat. No. 5,005,667 described in that patent as "a vertical cross section showing [a] step assembly in its extended position in front of [a] floor cabinet"

The principal components of the stair 1 are:

- a fixed portion which in this example takes the form of fixed frame 10;
- a movable portion which in this example takes the form of support frame 20;
- a tread 30;
- a translation mechanism which in this example takes the form of push-to-open mechanism 40;
- lifting mechanism 50; and
- actuation mechanism 60.

The push-to-open mechanism 40 connects the support frame 20 to the support frame 10 and allows the support frame 20 to horizontally translate relative to the fixed frame 10. The lifting mechanism 50 connects the tread 30 to the support frame 20 and allows the tread 30 to rise relative to the support frame 20.

Figure 2:
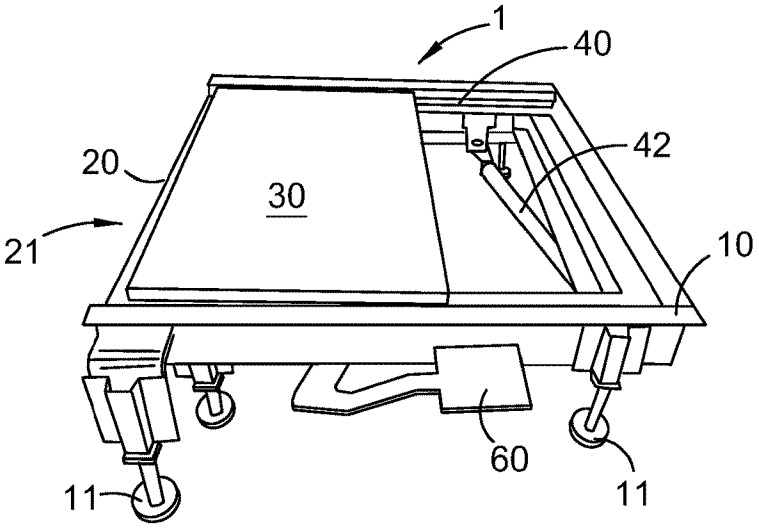
FIG. 2 is a side perspective view of a stair in its stowed configuration.

The stair 1 is intended to be installed at the base of kitchen cupboards (or other furniture item) so that it sits under the cupboards and in its stowed configuration (FIG. 2) only a fascia (not shown) carried by the front 21 of the support frame 20 is visible. In this configuration the tread portion 30 is concealed. Preferably the fascia takes the form of a kickboard matching the conventional static kickboards of the surrounding cupboards, so that the stair 1 unobtrusively blends in with the aesthetic of the kitchen.

The fixed frame 10 includes four height-adjustable feet 11 which bear on the floor of the kitchen (under the cupboards). The feet 11 are adjustable to level the tread 30 and to position the fascia relative to the surrounding kickboards and other cabinetry. It is also contemplated that the mounting of the fascia to the support frame 20 be adjustable so that it can be aligned relative to the adjacent cabinetry despite misalignment between the cabinetry and the floor, etc. It is also possible that (as well as or instead of feet 11) the fixed frame 10 be integrated with the cabinetry under which the stair is mounted.

The fixed portion is referred to as "fixed" because it remains stationary in use, in contrast to the movable portion which moves in use.

A preferred method of installation includes adjusting the feet 11 whilst the fixed portion 10 is positioned at the base of the furniture item. This may be achieved when the furniture item is inverted. Preferably the support feet are adjusted so that (when the cabinet is in its upright, installed, position) load is transmitted from the furniture item to the floor via the feet. When the feet are so adjusted the stair serves to strengthen the furniture item, in contrast the device of US Pat. No. 5,005,667 which depends from the cabinet C. Preferably the fixed portion is attached to the furniture item. This attachment may occur in the cabinetmaker's factory which may entail economies of scale. On the other hand, fitment in the field allows for units to be retrofitted to furniture manufactured by others. By way of example, the stair may be sold as a retrofit module.

The push-to-open mechanism includes a spaced pair of push-to-open drawer sliders 41, which sliders are proprietary items. Proprietary drawer sliders are used in the context of a drawer to eliminate the need for an outwardly projecting handle. Eliminating the handle allows for smoother/cleaner aesthetic. To open the drawer, a user momentarily presses on the front of the drawer to push the drawer inwardly a few millimeters. This pressing actuates the sliders to cause the drawer to open in the vicinity of 50mm or so (a couple of inches) so that a user may then grasp the top edge of the front vertical wall of the drawer to pull the drawer out to its extended, open, position.

Figure 3:
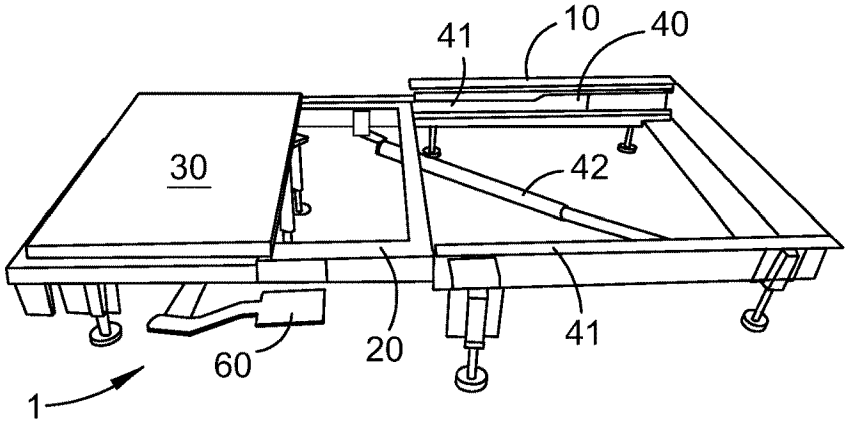
FIG. 3 is a side perspective view of the stair in its partially deployed configuration.

The push-to-open mechanism 40 further includes a booster mechanism, which in this example takes the form of a resiliently compressible strut 42 (FIGS. 2 and 3) to supplement the sliders 41. The strut is a bias. Other forms of bias are possible.

The strut 42 includes an outer tube 42 internally carrying a compression spring and an inner tube. The inner tube is mounted to slide within the outer tube. The strut 42 is thus telescopically extendable. The spring is arranged to act on the inner tube to bias the strut 42 towards its extended position.

One end of the strut 42 is pivotally mounted to the left-hand side of the movable support frame 20 whilst the other end of the strut 42 is pivotally mounted to the right-hand side of the fixed frame 10. The mounting points are such that as the tread portion is moved from its stowed position (FIG. 2) to its partially deployed configuration (FIG. 3) the strut 42 pivots. The strut 42 pivots from an orientation transverse to the tread's direction of travel (i.e. from the position illustrated in FIG. 2) towards the direction of travel. As in FIG. 3, the strut 42 remains transverse to the tread's direction of travel but the included angle between the strut's axis and the direction of travel is much reduced.

This geometry desirably meters the spring's effective application of force to provide steadier acceleration. The proportion of the spring's force applied to accelerating the support frame 20 (and the tread 30, mechanism 50, actuator 60 carried thereby) varies in proportion to the cosine of said included angle, so that as the strut 42 moves from the FIG. 2 to the FIG. 3 orientation, a larger proportion of its force is applied to the step. At the same time, the total force of the spring is reduced as it is decompressed. These countervailing factors somewhat cancel each other out, resulting in a more constant acceleration force.

Whatever form of translation mechanism (be it a push-to-open mechanism or otherwise), it is preferable to include some form of soft stop mechanism configured to decelerate the movable portion 20 over some distance, say at least 10 mm, as opposed to simply allowing the movable portion 20 to noisily crash into some form of stop. Preferred forms of soft stop mechanism include resilient means for decelerating the movable portion. One form of soft stop mechanism (not shown) includes a pair of elongate elements pivotally connected end-to-end so that the elements lie and pivot in a horizontal plane. One end of this assembly is pivotally connected to the fixed portion whilst the other end is pivotally connected to the movable portion such that, as the movable portion 20 is slid outward from its stowed position, the elements pivot from a position in which they are approximately seated one on top of the other towards a position in which the elements are aligned end-to-end. A stop is provided, in this case carried by the movable portion, to prevent the members fully straightening to the aligned end-to-end position for reasons to be described.

One of the elements is resiliently extensible. In this case the extensible element includes a short tension spring. As the movable portion is slid outwardly, and the elements abut the stop to prevent further straightening, continued outward movement of the movable portion stretches the tension spring. The tension spring is selected to decelerate the movable portion over 15 mm or so and indeed draws it back slightly. This has been found to reliably set the outward positioning of the stair from the cupboard without unpleasant banging and crashing.

Since the elements are prevented from fully straightening by the stop, they do not align to resist the movable portion being pushed from the semi-deployed position back into the stowed position. As such, the soft stop mechanism has no impact on the stowing operation.

When the stair is in its stowed configuration, a user may stand on the floor immediately in front of the stair 1, and then when there is a need to reach a higher shelf the fascia of the stair 1 can be kicked. A small kick inwardly moves the support frame 20 a short distance and so actuates the sliders 41 which in turn horizontally drive the support frame 20 a short distance outwards. The strut 42 then takes over so that the tread 30 overlies the portion of floor on which the person could stand moments ago.

Figure 4:
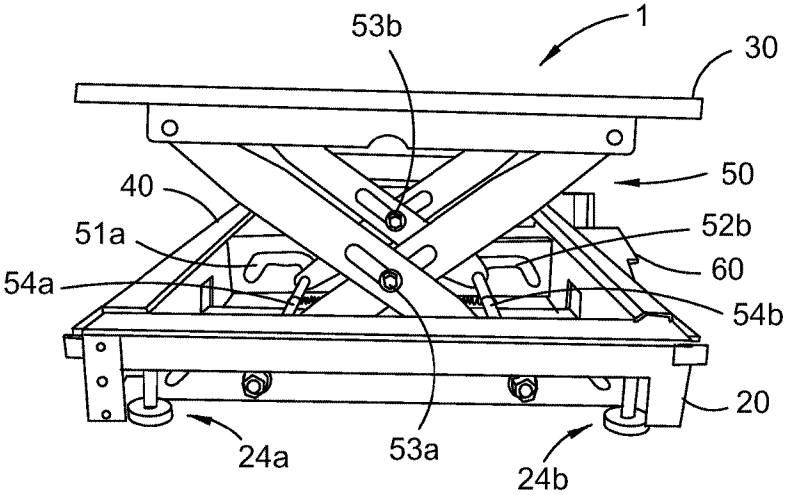
FIG. 4 is a front perspective view of the stair in its deployed configuration.
Figure 5:
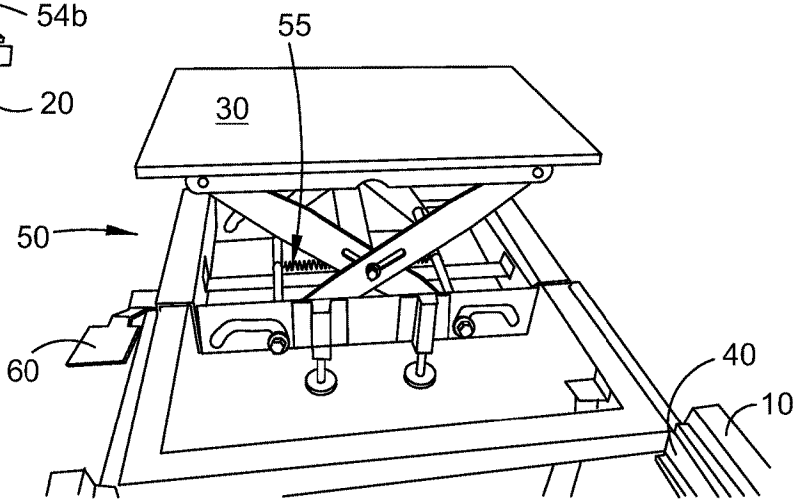
FIG. 5 is a rear perspective view of the stair in its deployed configuration.

From this position, the lifting mechanism 50 is actuated by pressing the pedal 61 of the actuator 60. In response to the actuator, the lifting mechanism 50 raises the tread 30 from the semi-deployed configuration (FIG. 3) to its deployed configuration (FIGS. 4 and 5). In its deployed configuration, the tread 30 is presented at a height a convenient step-up from the floor to enable access to elevated cabinetry and the items contained therein.

The translation mechanism is preferably configured to position the tread portion about 60 mm, or about 160 mm, horizontally outwards from the outermost portion of the cabinet. The present inventor has recognised that a tread portion immediately adjacent the cabinet is too close to be comfortably used. About 160 mm has been found comfortable for accessing a tall set of shelves, the outer extent of which is vertical. On the other hand, about 60 mm has been found to be convenient for accessing the overhead cupboards of a typical kitchen, which cupboards are horizontally set back relative to the underlying kitchen cabinet under which the stair unit is installed.

Figure 6A:
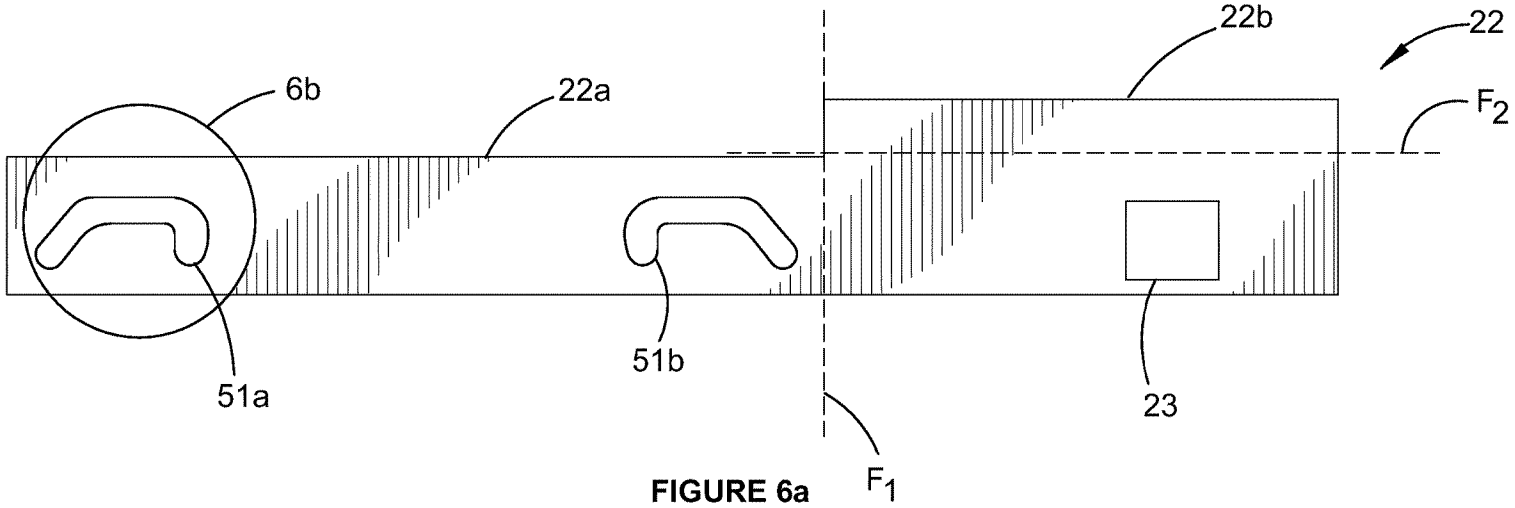
FIG. 6*a* is a plan view of a blank fore forming a support frame.

The support frame 20 includes four walls fencing in a rectangular area, which walls are formed from a blank 22 (FIG. 6*a*) and a similar blank. The blank 22 includes a section 22*a* and a section 22*b*. The blank 22 is folded along the fold line $F_1$ so that the portion 22*a* becomes the rearmost of the four walls and the portion 22*b* becomes the right-hand one of the four walls. The blank is also folded along fold line $F_2$ to form a short flange by which the four walls are connected to the rest of the support frame 20. In this example, the blank 22 is formed of 4mm thick bright mild steel.

A contoured guide slot 51*a* opens through the left-hand side of the portion 22*a*. Guide slot 51*b* opens through the right-hand side of the portion 22*a*. The slot 51*b* is a mirror image of the slot 51*a*, thus the slots 51*a*, 51*b* together constitute a symmetric pair of guides.

A rectangular aperture 23 opens through the portion 22*b*.

The lifting mechanism 50 includes a front pair and a rear pair of scissor arms 52. The arms 52 are substantially perpendicular to the fore-aft direction. Each arm is pivotally connected at its upper end to the tread portion 30. One arm of each pair is so mounted to pivot about a common pivot axis running along one side of the tread portion 30, whereas the other arm of each pair is so pivotally mounted to pivot about another common pivot axis running along the other side of the tread portion 30. The two common pivot axes are parallel to each other and run horizontally in the fore-aft direction. In this example, this direction is parallel to the direction in which the tread portion 30 moves from its stowed position to its partially deployed position.

Each arm 52 is an elongate blade including a respective 10 mm hole 52*a* at each of its ends and a lengthwise slot 52*b* running along its lengthwise centre line in the vicinity of its lengthwise centre point.

A nut and bolt assembly 53*a* skewers the slots 52*b* of the fore most pair of arms 52 and so interconnects those arms. The nut and bolt assembly 53*a* preferably includes a shoulder bolt configured to present a cylindrical surface to the interior of the slots 52*b* and to present a shoulder against which the nut can be tightened without clamping the arms 52. A similar nut and bolt assembly 53*b* likewise skewers and interconnects the arms 52 of the rearward pair of arms 52. Of course, other skewering arrangements are possible.

The slots 52*b* are preferably tapered slots, or at least include tapered portions, the sides of which converge on the bolt of the nut and bolt assembly 53*a* when the stair is elevated to its deployed position. A close fit between the slots 52*b* and the bolt when the stair is in its deployed position has been found to provide a more solid feel to the user. On the other hand, a looser fit at other points of the bolt's relative movement along the slot 52*b* has been found to provide for smoother, quieter, running.

The apertures 52*a* at the lower ends of the arms 52 carry a pair of pins 54*a*, 54*b*. The pins 54*a*, 54*b* are parallel to each other and run horizontally in the fore-aft direction. Thus the pins are connected to the tread portion 30 by the arm 52. A tension spring 55 (FIG. 5) acts between the pins 54*a*, 54*b*.

The scissor arms 52 are arranged to sit inside the rear wall defined by portions 22*a* and the similar front wall. The pins 54*a*, 54*b* extend horizontally beyond the arms 52 in the fore and aft directions to engage and sit within the slots 51*a*, 51*b* of both the rear wall and the forward wall.

Figure 6B:
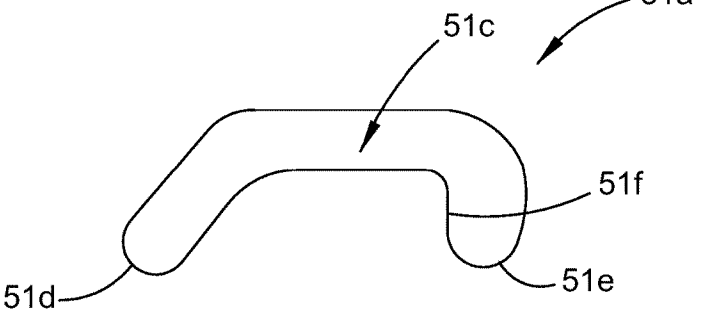
FIG. 6*b* is an enlargement of detail 6b in FIG. 6*a*.

Turning to FIG. 6*b* and remembering that the groove 51*b* is a mirror image of the groove 51*a*, the groove 51*a* includes an elevated horizontal central portion 51*c* separating relatively lower end portions 51*d*, 51*e* of the slot. An obliquely inclined portion connects the end 51*d* to the horizontal elevated portion 51*c*. A vertical portion 51*f* connects the horizontal elevated portion 51*c* to the end 51*e*.

The guides 51*a*, 51*b* and the pins 54*a*, 54*b* form interconnections connecting the arms 52 to the movable support frame 20.

The slots 51*a*, 51*b* serve to constrain the movement of the pins 54*a* and thus the shape of these slots and in particular the lower edges of these slots is important. The slot ends 51*d*, 51*e* define stable resting points at which the pins 54*a*, 54*b* sit when the tread portion 30 is in its stowed and deployed positions respectively.

When the tread portion 30 is lowered (e.g. when in its stowed or partially deployed positions), the scissor arms 52 are almost fully folded flat such that the left-hand and right-hand arms are parallel. For the avoidance of doubt, for each arm 52 a notional line connecting the centre points of the apertures 52*a* defines that arm's direction and it is the relative orientation of these notional lines which is important. For example, an arm may have a complex shape in between these two points without affecting functionality.

In this flat position, the pins are in their outermost positions and sit in the outer ends 51*d* of the guide slots 51*a*, 51*b*.

Figures 7A, 7B, 7C:
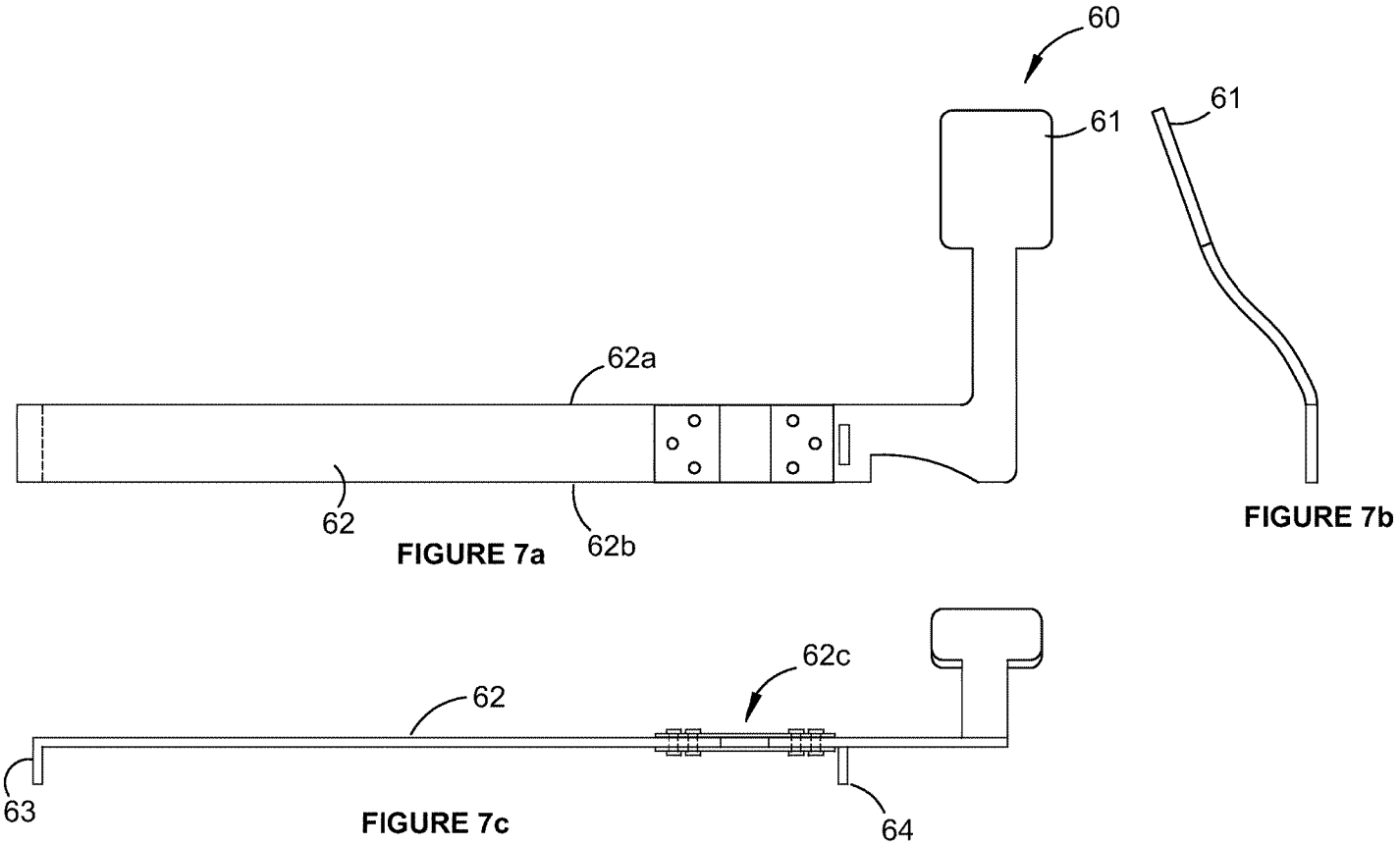
FIG. 7*a* is a plan view of an actuator.
FIG. 7*b* is a side elevation of the actuator.
FIG. 7*c* is a front elevation of the actuator.
Figure 8:
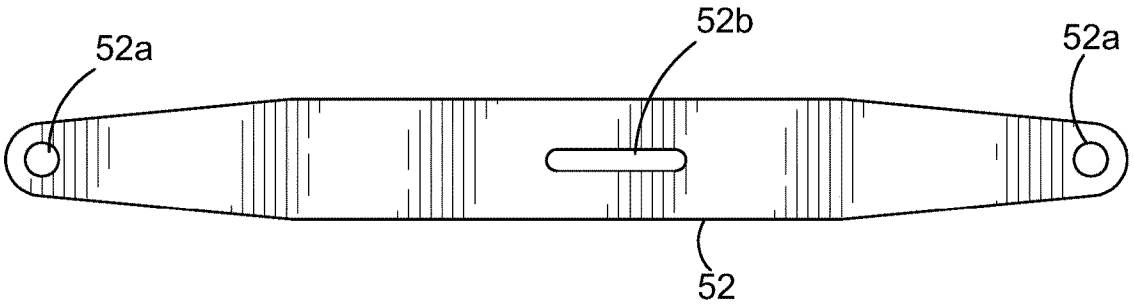
FIG. 8 is an elevation view of a scissor arm.

The actuator 60 is L-shaped when viewed in plan (FIG. 7*a*) including a long arm 62 and a short arm in the form of pedal 61.

The actuator 60 is predominantly formed of 5 mm thick bright mild steel but also includes a short resilient section 62*c*. In this example, the resilient section 62*c* is formed by a 20 mm wide break in the steel components spanned by a pair of spring-steel plates which span the gap and sandwich the mild steel either side of the gap. The resilient section 62*c* influences the feel of the pedal. Alternatively, the entire actuator 60 may be formed of a suitably resilient material, such as spring-steel.

The arm 62 is a blade in the vicinity of 400 mm long by 40 mm wide extending transversely across the supporting frame 20 and passing through each of the apertures 23. The blade 62 further includes an end fold 63 and an attached tab 64 adjacent the pedal 61. The fold 63 and tab 64 engage the frame 20 to resist removal of the actuator 60 therefrom.

The blade 62 underlies the pins 54*a*, 54*b*. Depressing the pedal 61 rotates the blade 62 to rotate about its rearward edge 62*a*, which edge bears against the lower edges of the apertures 23. Thus the forward edge 62*b* of the blade 60 is lifted. The edge 62*b* acts on the pins 54*a*, 54*b* to drive the pins 54*a*, 54*b* upwards. The pins 54*a*, 54*b* move upwards and inwards until they approach the horizontal portion 51 c of the guides 51 a, 51 b at which point the spring 55 takes over, inwardly driving the pins 54*a*, 54*b* towards the inner end of the guide 51*a*. At this point, the user releases the pedal 61 and the pins 54*a*, 54*b* drop into the inner ends 51*e* of the guides 51*a*. The pins 54*a*, 54*b* thus constitute striking portions that move into abutment with the inner ends 51*e*.

Thus the pedal 61 merely triggers the mechanism 50 and it is the spring 55 which does the bulk of the work to lift the tread portion 30.

The pedal 61 is mounted on the right-hand side of the stair to be operated by the user's right foot, although in other variants of the stair the pedal could be mounted on the other side.

When the tread 30 is in its deployed configuration (FIGS. 4 and 5), the pins 54*a*, 54*b*, sit in the guide ends 51*e* and these guide ends function as stops to prevent further movement of those pins. Moreover, given the described contours, when a user stands on the tread portion 30 their weight, transmitted via the arms 52, downwardly drives the pins into these stops. This abutment between the pins and the stops (in the form of slot ends 51*e*) gives a solid and reassuring feel to anyone standing on the step in contrast to potential arrangements in which any analogue of the spring 55 takes a portion of the person's weight.

The downward driving of the pins 54*a*, 54*b* into the guide ends 51*e* makes inadvertent collapse unlikely. Another safety means is the vertical slot section 51*f*. This slot section runs perpendicular to the spring 55 such that that spring in no way drives the pins to move upwardly along the slot. Of course, other variants are possible—by way of example, the portion 51*f* may be inclined so that the spring downwardly drives the pins to some extent.

Figure 10:
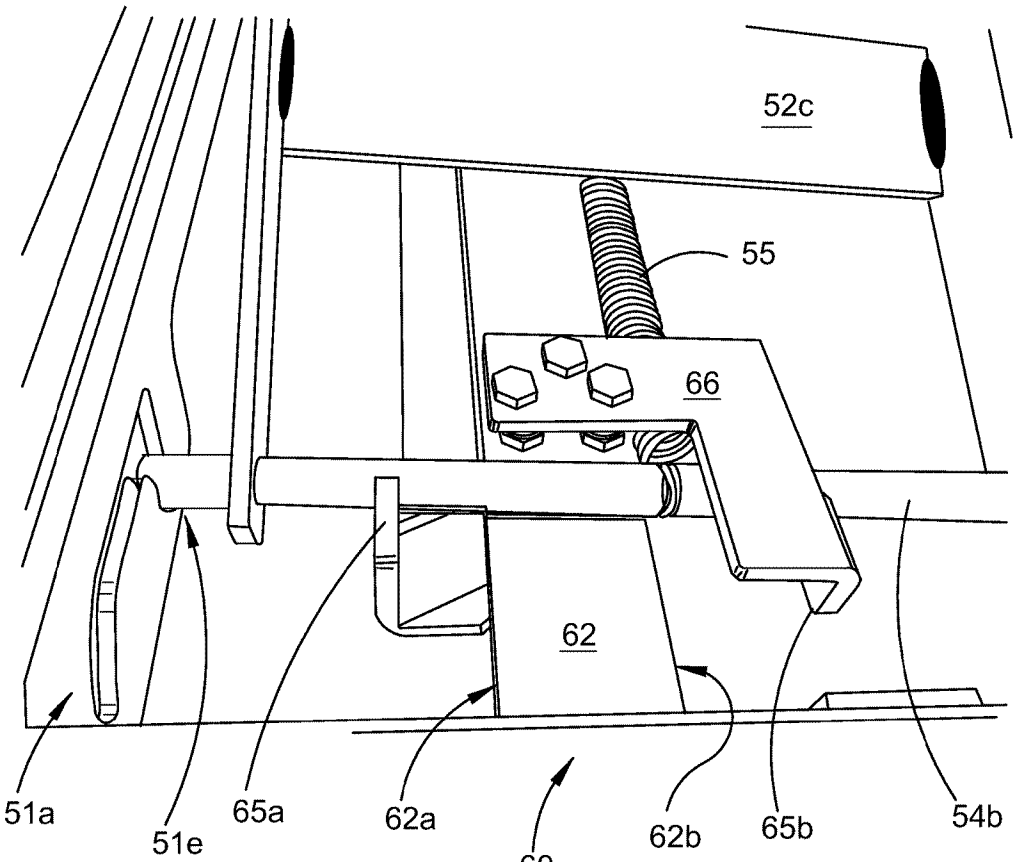
FIG. 10 is a perspective view of a blocking mechanism of a stair.

Optionally, the stair 1 may include a further safety means, for preventing inadvertent collapse, in the form of a blocking mechanism that at least limits downward movement of the tread portion by blocking movement of the tread portion and/or a portion that moves when the tread portion is lowered. In the variant of FIG. 10, the actuator 60 includes two blocking portions 65*a*, 65*b* mounted along its long arm 62. FIG. 10 illustrates the blocking mechanism of one side of the stair. Preferably a similar blocking mechanism appears at the other side of the stair.

FIG. 10 illustrates the stair 1 in its deployed position in which the pin 54*b* sits in abutment with the stop 51*e*.

In line with the previously described variant of the stair, to lower the stair, the pedal (not shown 61) is pressed to cause the arm 62 to pivot about its edge 62*a* (whereby that edge constitutes a pivot axis) so that the edge 62*b* upwardly drives the pin 54*b* away from the stop 51*e* and along the slot 51*f*.

The blocking portion 65*a* is positioned beyond the edge 62*a* and (when the stair is in its deployed position) extends upwardly from below the pin 54*b* to the blocking portion's free end above the pin 54*b*.

The blocking portion 65*b* sits beyond the edge 62*b* and is mounted at the free end of a cantilevered portion 66 of the member 60 that extends horizontally outwards over the top of the pin 54*b*. The blocking portion 65*b* extends downwardly from the portion 66 to the blocking portion's free end below the pin 54*b*. Both blocking portions sit horizontally outwards and alongside of the pin 54*b* when the stair is in its deployed position and the pedal is yet to be pressed.

The blocking portions 65*a*, 65*b* serve to prevent the pin 54 moving from the slot 51*f* to the horizontal portion 51*c*. Thus whilst a user carelessly jumping on an extreme edge of the stair may momentarily lift the pins within the slot 51*f*, the stair will not inadvertently collapse, and as soon as that extreme loading is removed the pin 54*b* will fall back into the slot end portion 51*e*.

On the other hand, since the blocking portion 65*a* is spaced from the pivot axis (the edge 62*a* in this case), rotation about that axis results in the portion 65*a* moving downwardly relative to the pin 54*b* so that its free upper end sits below the pin 54*b*. Of course, the pin 54*b* is moving upwardly at the same time, hence the portion 65*a* need not move as far as the diameter of the pin 54*b*. At the same time, the portion 65*b* is lifted by an amount related to the sum of the length of the slot 51*f* and the diameter of the pin 54*b*, whereby the stop 65*b* is positioned above the pin 54*b*.

This movement of the portions 65*a*, 65*b* opens a horizontal window aligned with the slot portion 51*c*, thereby allowing the pin 54*b* to slide along the guide 51*a*. As such, the stair 1 is lowerable when the blocking portions are in these positions.

In this example, the portions 65*a*, 65*b* are separate portions of material fastened to the arm 62 to form a single member. For the avoidance of doubt, whilst "member" and similar terms are used herein in their conventional sense to take in multi-component members (for example the term is not limited to integrally formed members), the terms do not go so far as to take in members connected by, for example, pivotal connections. Resilient members are possible. Indeed, members incorporating resilient sections such as the section 62*c* are possible.

In a variant of the stair similar to the variant of FIG. 10, a portion 52*c* spans the distance between the forward pair of scissor arms and the rearward pair of scissor arms, and the blade 62 includes or carries a portion to act on that spanning portion, so that it is the spanning portion rather than the pins 54*a*, 54*b* which are lifted to actuate the lifting mechanism. By so upwardly driving the spanning portion to actuate the mechanism, not only are the pins lifted from the slot end portions 51*d* but the scissor arms 52 are moved away from their fully flat position so that the spring 55 may take over.

To lower the tread portion 30, a user depresses the pedal 61 with one foot to again rotate the blade 62 to lift the pins 54*a*, 54*b* and move the blocking portions 65*a*, 65*b* to their movement-allowing positions. So lifting the pins 54*a*, 54*b* lifts them from the slot end portion 51*e* towards the horizontal slot portion 51*c*. Next the user stands on the tread portion with their other foot. As the tread portion 30 is downwardly driven, through the action of the scissor arms 52, the pins 54*a*, 54*b* are outwardly driven along the horizontal slot portion 51*c* and horizontally through the horizontal gap between the blocking portions. Once this horizontal movement is initiated, the user releases the pedal 61 so that the step may be driven home until its pins lie in the outer slot end portions 51*d*. The lifting mechanism 50, and in particular its spring 55, are thus loaded and reset to the lowered position. Then, by pushing on the fascia, the supporting frame 20 and tread portion 30 carried thereby can be returned to their stowed position under the cupboard.

Supports in the form of height-adjustable feet 24*a*, 24*b* carried by the support frame 20 contributes to the solid, stable, feel of the stair 1. In this example, the supports take the form of neoprene bottomed feet 24*a*, 24*b*. A neoprene bottom is an example of a high friction surface to resist sliding across the floor whilst the stair is bearing a portion of the person's weight. Other means of engagement are possible. By way of example, the supports may take the form of keys co-operable with complementary keyways formed in the floor. The present inventor has recognised that without such means of engagement, there is a risk of the stair inadvertently sliding across the floor towards the cupboard under which it is installed, when a user steps onto the step from some distance back so as to apply a significant horizontal force. The means of engagement resist this horizontal force which prevents inadvertent horizontal movement of the stair and so contributes to the solid and stable feel of the stair.

The height of the feet 24*a*, 24*b* is adjusted so that they clear the floor when the step is unloaded. Preferably the clearance is only a few millimeters. The clearance is significant in that the feet can clear, and so smoothly move across, any irregularities in the floor. In particular, the present inventors have recognised that the tiles of a tiled kitchen floor are often laid only shortly beyond the outer extent of the kitchen cabinets, whereby the edge of the tiles under the kitchen cabinets is an adverse step with the potential to impede the outward progress of a support foot in contact with the ground. Setting the feet to clear the floor avoids this adverse step.

When a person stands on the step, the resilience of the frames 10, 20 and the push-to-open mechanism 40 permit a very small downward deflection of the cantilever portion such that the feet 24*a*, 24*b* are driven against the floor and most, if not substantially all, of the person's weight is transmitted to the floor via these feet. Since these feet move with the support frame 20, they are in use mounted in close proximity to the tread portion 30 to define upright load paths down to the floor as opposed to the horizontal or inclined load paths that arise in cantilever arrangements. This connection to the portion of floor underlying the tread 30 (or at least to the floor in that vicinity) reduces the elasticity of the system.

Many variants of the lifting mechanism 50 are contemplated. By way of example, the lower ends of the arms 52 might be fitted with guide slots that co-operate with pins carried by the support frame 20, or indeed the whole mechanism might in essence be inverted by providing simple pivotal connections between the supporting frame 20 and the arms 52 and moving the more elaborate interconnections including pins and guide slots (etc) to the top of the arms. Of course, variants of these possibilities are also possible. Indeed other variants are possible without guides of any sort.

Figure 9:
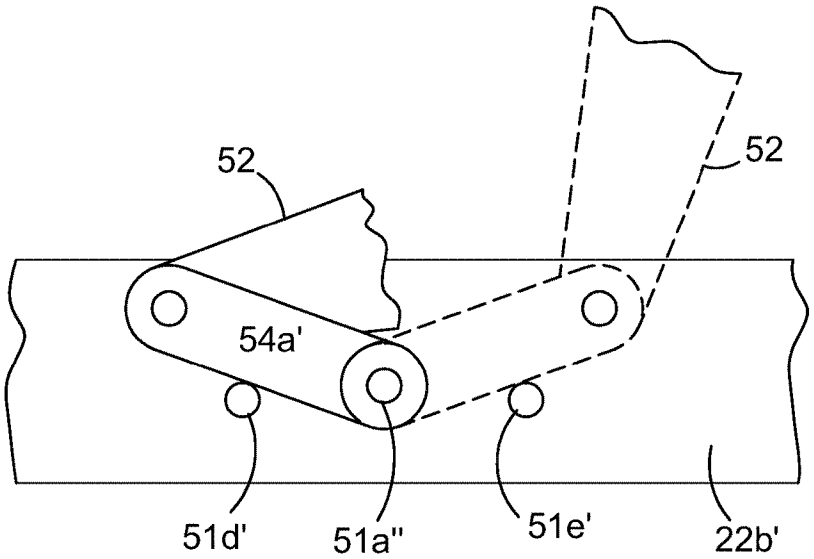
FIG. 9 schematically illustrates an alternative interconnection.

FIG. 9 schematically illustrates a guideless variant including a link 54*a* pivotally mounted to each of the support frame portion 22*b*' and to an arm 52. The arm 54*a* constitutes a striking portion which moves into abutment with the stops 51*d*', 51*e*' at each extreme of its motion. As in the abutment between the pins 54*a* and stop 51*e*, the link 54*a*' is driven into the stop 51*e* by the weight of a person standing on the step. In FIG. 9 the link 54*a*' and arm 52 in their stowed positions are shown in solid line and in their deployed positions are shown in dotted line.

The tread portion 30 in this example includes a simple flat horizontal plate and on the plate's underside a respective vertical transverse flange towards its front and towards its back. The tread portion 30 is pivotally connected to the arms 52 via these flanges. An upper surface of the tread portion 30 is a tread face and desirably is a non-slip surface. The non-slip surface might take the form of texture molded integrally with the plate or might be formed by a non-slip layer retained by adhesive. Other forms of tread portions are possible—by way of example, the tread could be a simple rung.

The described stair 1 includes a single tread 30 although more elaborate arrangements might incorporate multiple treads.

Various of the described details can be usefully applied without other of the described details. By way of example, the lifting mechanism 50 may be usefully applied without any mechanism akin to the push-to-open mechanism 40 such as in a height-adjustable kick step. Likewise the push-to-open mechanism 40 may be usefully applied without the lifting mechanism 50.

To summarise, in operation of the stair 1 a user approaches the stowed stair 1 and simply kicks its fascia to move the tread portion 30 outwardly from under the cabinetry in which it is installed to the partially deployed position in which the tread 30 overlies an otherwise useable floor portion. Then by simply momentarily depressing the pedal 61 the tread portion 30 rises to a convenient height under the impetus of spring 55. Once the user is finished using the step the following sequence is followed:

1. the pedal 61 is depressed;
2. the tread portion 30 is depressed;
3. the pedal 61 is released;
4. the tread portion is released to return the stair 1 to its semi-deployed configuration.

From that semi-deployed configuration gently pushing the stair inwards with one's foot returns the stair to its stowed configuration.

The above series of steps has been found to be simple and intuitive, and certainly much simpler than it appears on paper. Notably, it allows for convenient, hands-free operation.

The described stair is entirely mechanical, making it simple, robust and low-maintenance. More elaborate variants are possible. For example, electro-mechanical variants might incorporate a linear motor in place of the push-to-open mechanism and another linear motor in place of the spring 55 and actuator 60. Electro-mechanical variants may be operable by a button, or other user interface, potentially mounted remotely from the stair, or could even be voice-activated.

As noted, the invention is not limited to the context of kitchens. Indeed some stairs may be employed outdoors. For the avoidance of doubt, simple earthen ground may define a "floor" as the term and similar terms are used herein.

The invention claimed is:

1. A stair including:

a stationary portion;

at least one tread portion lowerable relative to the stationary portion from a deployed position in which the tread portion is presented to be stepped on by a person;

a movable portion connected to the tread portion to move relative to the stationary portion as the tread portion is lowered;

blocking portions; and a pedal connected to the blocking portions such that pressing the pedal moves the blocking portions:

from positions in which the blocking portions block movement of the movable portion relative to the stationary portion, to at least limit lowering of the tread portion from the deployed position, to positions in which the tread portion is lowerable from the deployed position, relative to the stationary portion;

wherein the blocking portions and the pedal are portions of a member;

the blocking portions are arranged to at least substantially pivot, about a pivot axis, with the pedal; and the movable portion intersects a vertical plane parallel to the pivot axis; and on each side of the pivot axis is positioned a respective one of the blocking portions.

2. The stair of claim 1 wherein the pivot axis runs at least approximately horizontally.

3. The stair of claim 1 wherein the movable portion connected to the tread portion is a horizontally extending member.

4. The stair of claim 1 including:

a mechanism by which the tread portion is mounted to move:

from a stowed position in which the person may stand on a portion of a floor;

to a deployed position in which the tread portion is presented, over the portion of the floor, to be stepped on by the person;

the deployed position being higher than the stowed position.

5. The stair of claim 4 including one or more supports mounted to move, as the tread portion is moved, to a position in which the supports engage the floor to transmit to the floor at least a portion of a weight of the person.

6. The stair of claim 4 including a push-to-open mechanism which is foot-actuatable to move the tread portion away from its stowed position, relative to the stationary portion.

7. A stair including:

a stationary support frame;

a movable frame;

at least one tread portion connected to the movable frame;

a pedal; and a moving mechanism comprising:

a translating mechanism, which translates the movable support frame from a stowed position to an extended position relative to the stationary support frame;

an elevating mechanism actuable to raise the tread portion to and lower the tread portion from a deployed position relative to the movable support frame when the movable support frame is in the extended position, the tread portion being positioned higher in the deployed position than in the stowed position, and being presented in the deployed position to be stepped on by a person, the elevating mechanism comprising:

a stop;

a striking portion arranged to, when the tread portion is elevated by the elevating mechanism to the deployed position, move to a resting point at which the striking portion is in abutment with the stop and arranged to be driven against the stop by at least a portion of a weight of the person; and a spring, which biases the elevating mechanism toward the deployed position;

the pedal being pressible, whilst the tread portion is at the deployed position, to move the striking portion away from the stop;

the elevating mechanism being configured such that, when the striking portion is moved away from the stop by the pedal being pressed, depressing the tread portion:

moves the striking portion further away from the stop, against the bias of the spring; and loads and resets the elevating mechanism.

* * * * *